US008230841B2

(12) United States Patent
Okada et al.

(10) Patent No.: US 8,230,841 B2
(45) Date of Patent: Jul. 31, 2012

(54) TWO STEP PRESSURE CONTROL OF FUEL PUMP MODULE

(75) Inventors: Kingo Okada, Toyohashi (JP); Dhyana Ramamurthy, Novi, MI (US)

(73) Assignee: DENSO International America, Inc., Southfield, MI (US)

( * ) Notice: Subject to any disclaimer, the term of this patent is extended or adjusted under 35 U.S.C. 154(b) by 605 days.

(21) Appl. No.: 12/411,119

(22) Filed: Mar. 25, 2009

(65) Prior Publication Data

US 2010/0242923 A1 Sep. 30, 2010

(51) Int. Cl.
*F02M 37/08* (2006.01)

(52) U.S. Cl. ..... 123/511; 123/495

(58) Field of Classification Search ..... 123/497, 123/495, 515, 514, 511
See application file for complete search history.

(56) References Cited

U.S. PATENT DOCUMENTS 5,477,829 A 12/1995 Hassinger et al.
5,572,974 A * 11/1996 Wakeman ..... 123/497
5,731,515 A * 3/1998 Tominaga et al. ..... 73/114.41
6,024,064 A * 2/2000 Kato et al. ..... 123/179.17
6,253,735 B1 * 7/2001 Miyajima ..... 123/456
6,279,317 B1 * 8/2001 Morgan ..... 60/413
6,318,344 B1 * 11/2001 Lucier et al. ..... 123/516
6,705,298 B2 3/2004 Ramamurthy et al.
7,284,539 B1 * 10/2007 Fukasawa ..... 123/506
7,318,415 B2 * 1/2008 Fukasawa ..... 123/458
7,318,421 B2 * 1/2008 Fukasawa ..... 123/491
7,383,822 B2 * 6/2008 Ramamurthy et al. ..... 123/509
7,431,020 B2 10/2008 Ramamurthy
2003/0219346 A1 * 11/2003 Abe et al. ..... 417/307
2004/0074995 A1 4/2004 Okada
2005/0155582 A1 * 7/2005 Schelhas et al. ..... 123/497
2006/0065246 A1 * 3/2006 Zdroik ..... 123/497
2007/0186908 A1 * 8/2007 Fukasawa ..... 123/458
2008/0184971 A1 * 8/2008 Lubinski et al. ..... 123/511
2008/0236550 A1 * 10/2008 Kobayashi et al. ..... 123/514
2009/0000673 A1 1/2009 Ramamurthy
2010/0101536 A1 * 4/2010 Nakata ..... 123/457
2010/0263634 A1 * 10/2010 Futa et al. ..... 123/511
2010/0307459 A1 * 12/2010 Steinbach et al. ..... 123/511

* cited by examiner

*Primary Examiner* — Stephen K Cronin
*Assistant Examiner* — Arnold Castro
(74) *Attorney, Agent, or Firm* — Harness, Dickey & Pierce, PLC

(57) ABSTRACT

A fuel system comprises a fuel line that supplies fuel to an engine at a fuel line pressure. A first fuel pump selectively supplies fuel to the fuel line at a first pressure. A second fuel pump selectively supplies fuel to the fuel line at a second pressure that is greater than the first pressure. A check valve having an inlet in communication with an exit port of the first fuel pump and an outlet in communication with the fuel line is positioned based on the fuel line pressure and the first pressure.

15 Claims, 6 Drawing Sheets

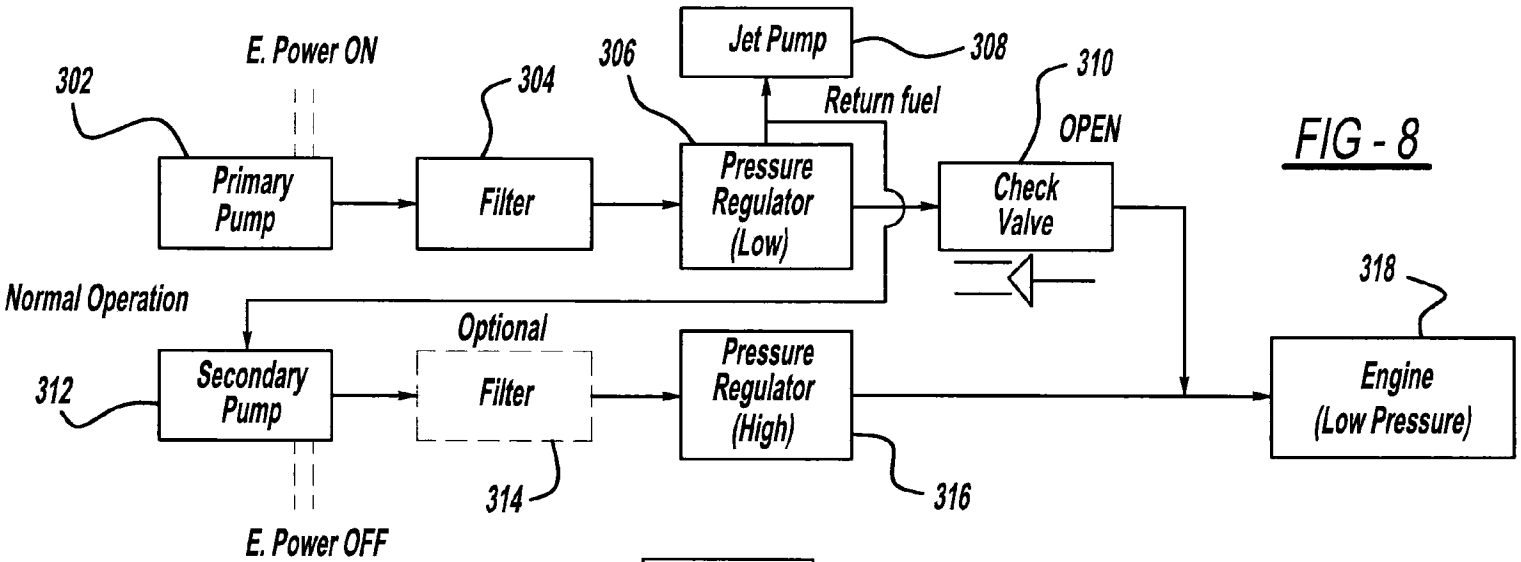
FIG - 8
Engine (Low Pressure)
318
Check Valve
310
OPEN
Jet Pump
308
Return fuel
Pressure Regulator (Low)
306
Pressure Regulator (High)
316
Filter
304
Optional
Filter
314
E. Power ON
Primary Pump
302
Normal Operation
Secondary Pump
312
E. Power OFF

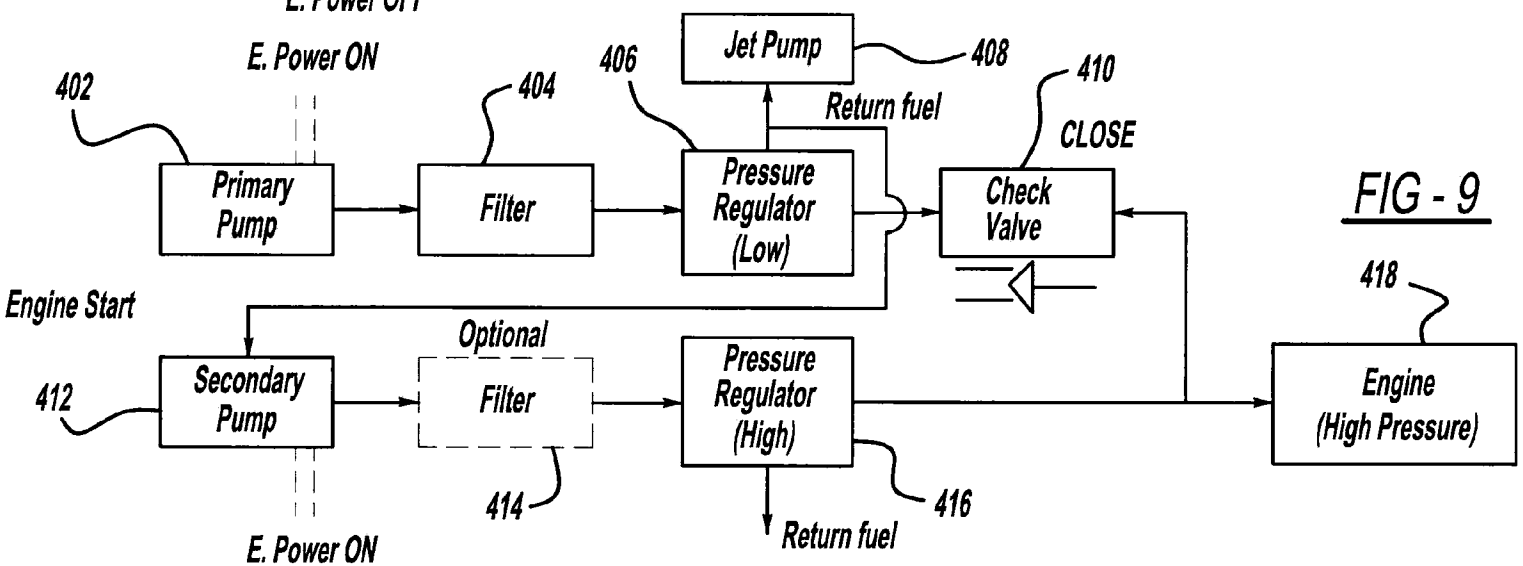
FIG - 9
Engine (High Pressure)
418
Check Valve
410
CLOSE
Jet Pump
408
Return fuel
Pressure Regulator (Low)
406
Pressure Regulator (High)
416
Return fuel
Filter
404
Optional
Filter
414
E. Power ON
Primary Pump
402
Engine Start
Secondary Pump
412
E. Power ON

TWO STEP PRESSURE CONTROL OF FUEL PUMP MODULE

FIELD

The present disclosure relates to a mechanical returnless fuel system, and more specifically, to a two step pressure control of a fuel pump module.

BACKGROUND

The statements in this section merely provide background information related to the present disclosure and may not constitute prior art. Conventional vehicular fuel systems, such as those installed in vehicles, such as automobiles, may employ a "return fuel system" whereby a fuel supply tube is utilized to supply fuel to an engine and a fuel return line is utilized to return, hence "return fuel system," unused fuel to a fuel tank. Such return fuel systems require the use of both a supply line to and a return fuel line from the engine. More modern vehicles typically employ a "returnless fuel system" that may either be mechanically or electronically controlled.

Regarding such returnless fuel systems, such as a mechanical returnless fuel system ("MRFS"), only a fuel supply line from a fuel tank to the engine is utilized; therefore, no return fuel line from the engine to the fuel tank is necessary. As a result, an MRFS delivers the volume of fuel required by an engine, regardless of the varying degree of the volume of fuel required; however, the fuel pump operates at 100% capacity irrespective of engine demand, with excess fuel being discharged through a fuel pump module via the pressure regulator. In a MRFS, interaction with an electronic control module or vehicle body control module may not normally occur.

During operation of a vehicle employing an MRFS such as that discussed above, the engine typically cycles through periods of acceleration, intermediate speed operation, deceleration, idle and engine off conditions. The MRFS pumps fuel to the rail to maintain a constant pressure based on the pressure regulator. However, the rail pressure may increase or decrease due to the various cycles.

An additional problem may occur upon engine start-up when the vehicle is exposed to high ambient temperatures after engine shutoff. In such a circumstance, residual engine heat, along with the ambient heat, may cause fuel pressure within the fuel rail to vaporize thereby compromising engine restart.

SUMMARY

A fuel system comprises a fuel line that supplies fuel to an engine at a fuel line pressure. A first fuel pump or delivery module selectively supplies fuel to the fuel line at a first pressure, while a second fuel pump or delivery module selectively supplies fuel to the fuel line at a second pressure that is greater than the first pressure. A check valve may have an inlet in communication with an exit port of the first fuel pump and an outlet in communication with the fuel line.

The fuel system check valve is closed when a difference between the fuel line pressure and the first pressure is greater than a predetermined check valve opening pressure, such as 20 kPa. The check valve prevents the first fuel pump from supplying fuel to the fuel line. The fuel system positions the check valve when a difference between the fuel line pressure and the first pressure is less than or equal to a check valve opening pressure. The check valve allows the first fuel pump to supply fuel to the fuel line. The second fuel pump supplies fuel to the fuel line during an engine start.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein:

FIGS. 8-10 are flowcharts depicting exemplary steps for controlling the fuel pump system of the present disclosure.

DETAILED DESCRIPTION

Figure 1:
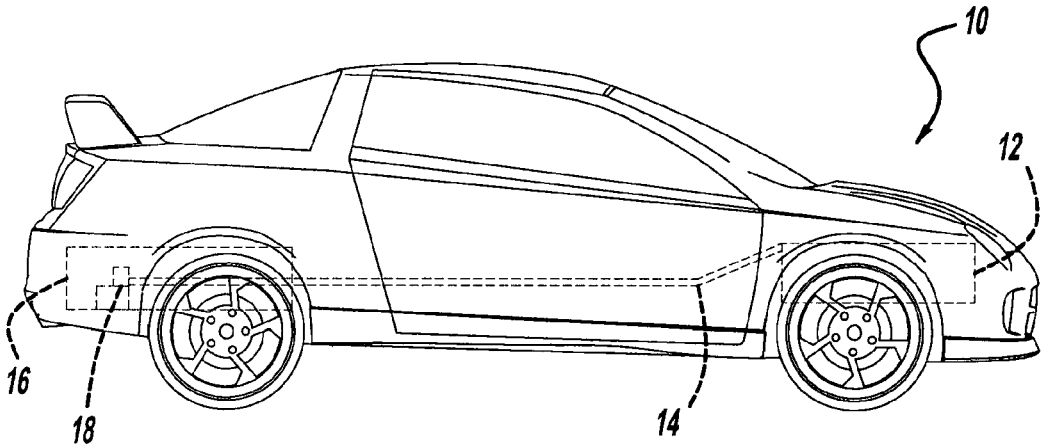
FIG. 1 is a perspective view of a vehicle depicting a fuel system in phantom.

The following description is merely exemplary in nature and is not intended to limit the present disclosure, application, or uses. It should be understood that throughout the drawings, corresponding reference numerals indicate like or corresponding parts and features. With reference to FIGS. 1-10, description of a fuel delivery system for a mechanical returnless fuel system ("MRFS") will be described.

The two step pressure control fuel pump system of the present disclosure may provide two fuel pressures to satisfy engine fueling demands. The fuel pump system may include a first fuel pump and a second fuel pump. The first fuel pump includes a first pressure regulator to maintain fuel pressure at a first pressure. The second fuel pump includes a second pressure regulator to maintain fuel pressure at a second pressure that is greater than the first pressure.

A check valve in communication with the first pressure regulator and the fuel line may open and close based on a differential pressure between the first pressure and the pressure in the fuel line. The first pump may be activated when the ignition system or engine power is on. The first pump operates at a constant speed to supply fuel at the first pressure to the fuel line while the engine is running.

The second pump may be used to increase the fuel line pressure during an engine start or during other operating conditions such as high engine loads. The second pump may operate at a constant speed to supply fuel at a second pressure that is greater than a first pressure of the first pump. The second pump may be activated based on various engine operating conditions such as air and coolant temperatures, engine on/off times, engine speed, and engine load.

When the second pump is activated, the fuel line pressure may increase to the second pressure. The differential pressure between the fuel line pressure and the first pressure forces the check valve closed and blocks fuel from the first pump. The first pump may continue to circulate or recirculate fuel through various jet pumps and to the second pump. When the second pump is deactivated, the second pressure decreases or is removed from the fuel line. The differential pressure decreases until the check valve opens and allows the first pump to supply fuel to the fuel line at the first pressure.

FIG. 1 depicts a vehicle such as an automobile 10 having an engine 12, a fuel line 14, a fuel tank 16, and a fuel pump module 18. The fuel pump module 18 fits within the fuel tank 16 and is normally submerged in or surrounded by varying amounts of liquid fuel within the fuel tank 16 when the fuel tank 16 possesses liquid fuel. A fuel pump within the fuel pump module 18 pumps fuel to the engine 12 through the fuel line 14.

Figure 2:
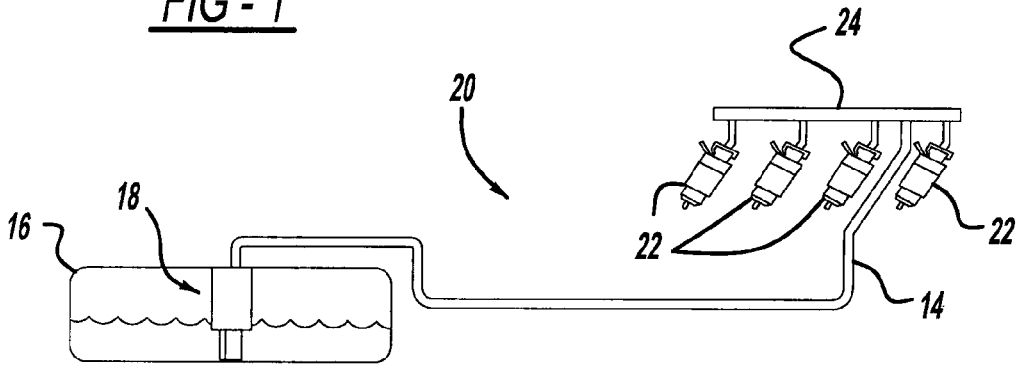
FIG. 2 is a perspective view of a vehicle fuel supply system depicting fuel injectors.

FIG. 2 is a perspective view of a vehicle fuel supply system 20. In a mechanical returnless fuel system (MRFS), the fuel line 14 carries fuel between the fuel pump module 18 and fuel injectors 22 attached to a fuel rail 24. Once the fuel reaches the fuel rail 24, also called a "common rail," as depicted in FIG. 2, the fuel passes into individual fuel injectors 22. The fuel injectors 22 spray or inject the fuel into the intake manifold of the internal combustion engine 12. The fuel supply system 20 has no fuel return line from the fuel rail 24 to the fuel tank 16.

Figure 3:
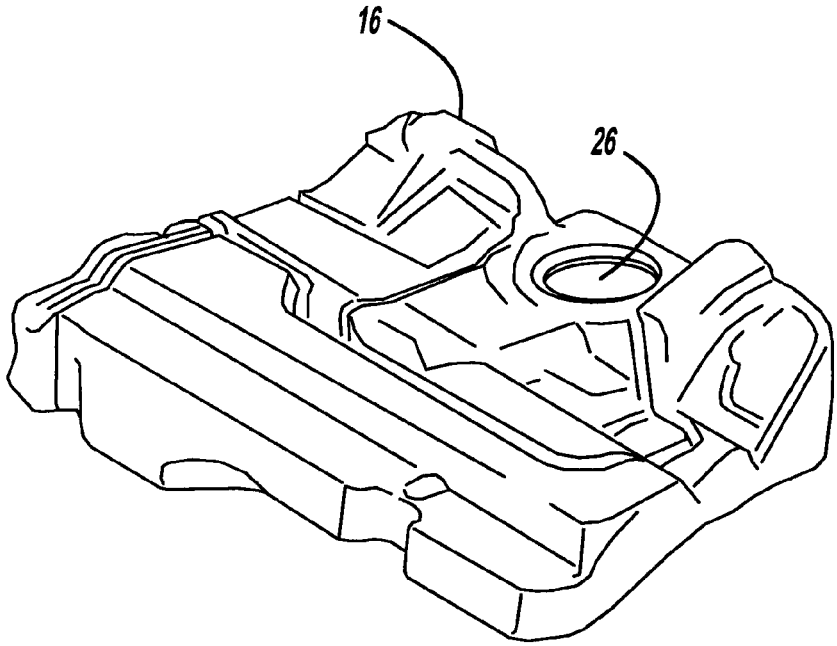
FIG. 3 is a perspective view of a vehicle fuel tank depicting the location of a fuel pump module.
Figure 4:
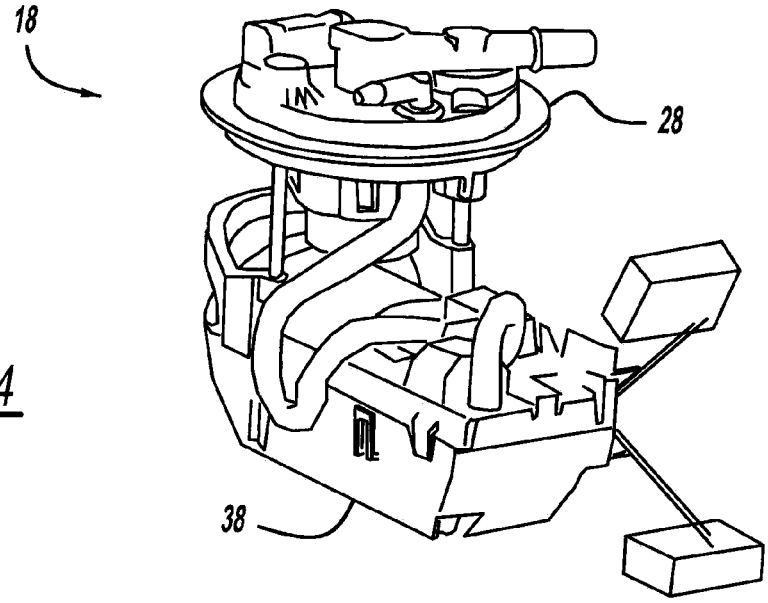
FIG. 4 is a perspective view of a fuel pump module.
Figure 7:
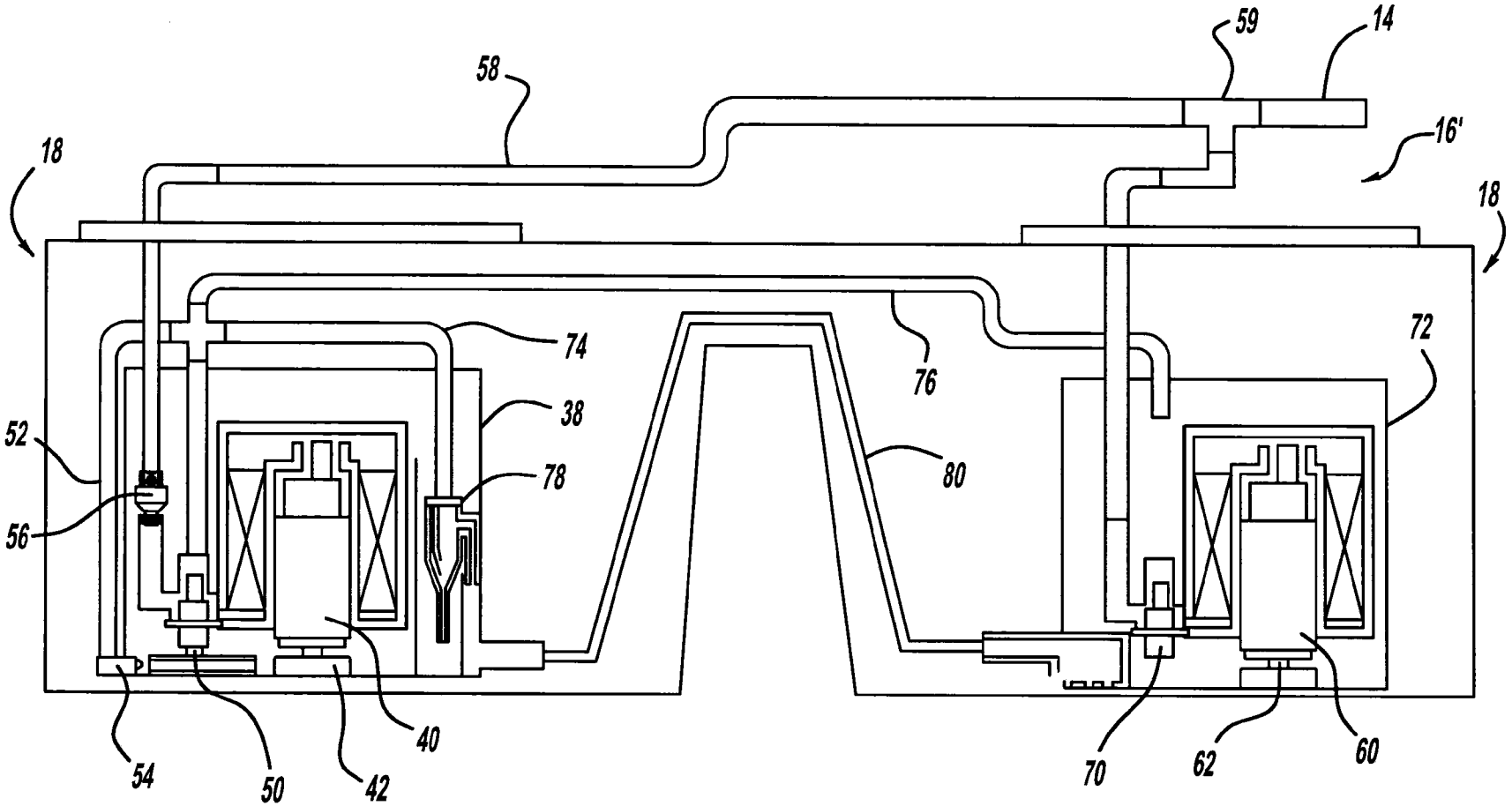
FIG. 7 is a side view of two fuel pump modules according to the principles of the present disclosure.

FIG. 3 is a perspective view of the vehicle fuel tank 16 depicting a mounting location 26 for the fuel pump module 18. The fuel tank 16 may also be a saddle fuel tank that includes a pair of mounting locations 26 for a pair of fuel pump modules 18 as depicted in FIG. 7. FIG. 4 depicts one embodiment of the fuel pump module 18 that may be lowered into the mounting location 26 of the fuel tank 16 when installed. A flange 28 may attach the fuel pump module 18 to the tank 16.

Figure 5:
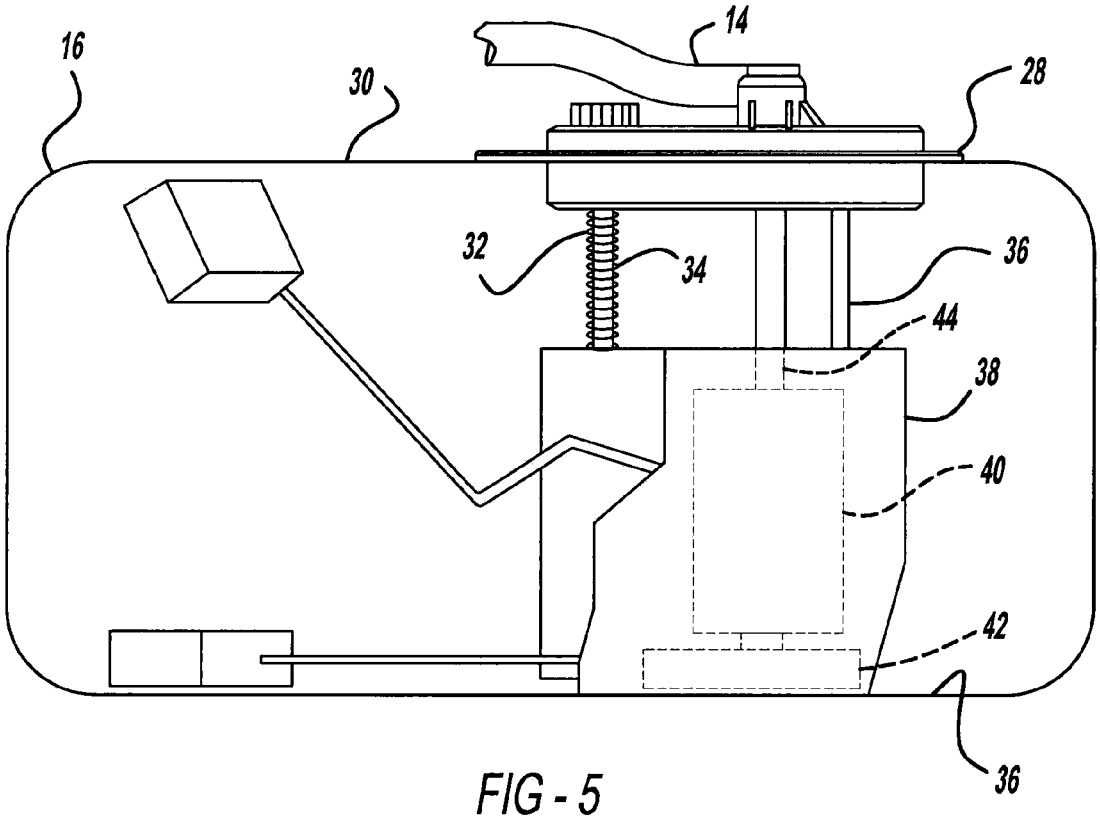
FIG. 5 is a side view of a fuel pump module in its installed position within a vehicle fuel tank.

FIG. 5 depicts the fuel pump module 18 in an installed position in fuel tank 16. The flange 28 rests on a top surface 30 of the fuel tank 16 when the fuel pump module 18 is in the installed position. Although the flange 28 ultimately abuts the top surface 30 of the fuel tank 16 upon installation of the module 18, the flange 28 must be forced downwardly or onto the fuel tank 16. A spring 32, which resides around the first strut 34, causes a reservoir 38 of the fuel pump module 18 to be held against the fuel tank floor by the force of the spring 32. A second strut 36 assists in securing the reservoir 38, and although not depicted, a second spring may be secured around the second strut 36.

Upon compression of the spring 32 or springs, the flange 28 is secured to the top surface 30 of the fuel tank 16 by a locking ring (not shown) or similar device. While the flange 28 creates a seal around the periphery of the mounting location 26, the reservoir 38 is securely held against the bottom floor of the fuel tank 16. While the fuel pump module 18 of FIG. 4 depicts a generally horizontally elongated reservoir 38, the reservoir 38 may be designed to be more vertically cylindrical as depicted in FIG. 5, either of which is suitable for the teachings of the present disclosure.

FIG. 5 depicts the fuel pump module 18 with a fuel pump 40 residing within the reservoir 38. The fuel pump 40 draws liquid fuel from inside the reservoir 38, through a fuel sock filter 42 and ultimately through the fuel pump 40 itself where the fuel is discharged from an exit port 44. The fuel exits the fuel pump module 18 to the fuel line 14.

Figure 6:
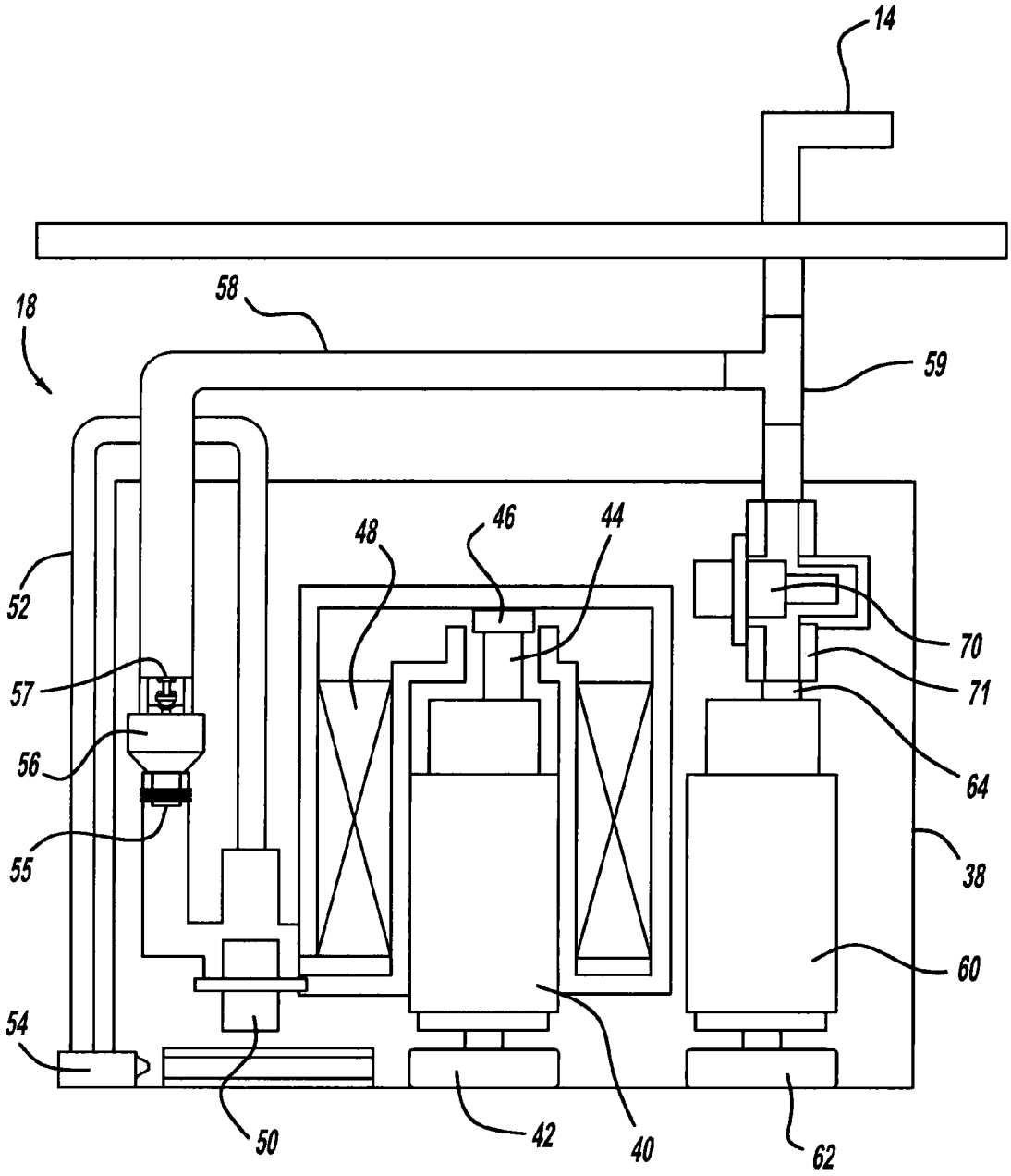
FIG. 6 is a side view of a fuel pump module according to the principles of the present disclosure.

Now, a more detailed explanation of the teachings of the disclosure will be presented beginning with FIG. 6, which depicts a first configuration of a fuel system according to the teachings of the present disclosure. The fuel pump module 18 may include the fuel pump 40 which may be a primary pump. The Primary pump 40 may operate at a constant speed if the applied voltage is constant, or a varying speed if the applied voltage varies, while turned on or powered on using electricity. Primary pump 40 may be powered on when engine power associated with the vehicle 10 is turned on (i.e., traditionally, when a key is turned). Fuel within the reservoir 38 is drawn through the fuel sock 42 into the primary pump 40. After being drawn into the primary pump 40, fuel is pumped to the exit port 44 and may pass through a check valve and then through a filter 48, which may surround the fuel pump 40, before reaching a first pressure regulator 50. The pressure check valve 46 maintains fuel between the exit port 44 and the first pressure regulator 50, and prevents fuel and pressure from passing back through the fuel pump 40 and out the fuel sock 42, when the pump 40 is off.

First pressure regulator 50 maintains a constant first fuel pressure while primary pump 40 is powered on. Excess fuel may be recirculated in the fuel pump module 18 through a jet pump tube 52 extending from the regulator 50 to a jet pump 54. The jet pump 54 may cause a Venturi effect to draw fuel into the reservoir 38 from the fuel tank 16. Fuel is pumped via the first pressure regulator 50 to an inlet 55 of a flow check valve 56 when the valve 56 is open. Fuel may continue to an outlet 57 of the flow check valve 56. Fuel continues through a connecting tube 58 that leads to a T-joint 59. T-joint 59 connects with the fuel line 14 and a second fuel pump, which is discussed below.

With continued reference to FIG. 6, the flow check valve 56 opens and closes based on a pressure differential between a pressure at the inlet 55 and a pressure at an outlet 57 of the flow check valve 56. The pressure on the inlet 55 may be considered the first fuel pressure of pressure regulator 50. The pressure on or at the outlet 57 depends on the fuel line pressure in the fuel line 14. When the pressure differential between the fuel line pressure and the first pressure is less than a check valve opening pressure, such as when the first pressure is greater than the fuel line pressure, the flow check valve 56 opens. When the difference between the fuel line pressure and the first pressure is greater than the check valve opening pressure, such as when the first pressure is less than the fuel line pressure, the flow check valve 56 closes. The pressure at which the flow check valve 56 opens, such as 20 kPa for example, may be chosen based on fuel pressure requirements of the vehicle 10.

The fuel pump module 18 may include a second fuel pump 60 which may be a secondary fuel pump. Secondary pump 60 may be activated when engine power is on and other operating conditions exist as discussed below. When secondary pump 60 is activated, fuel flows similarly to the primary pump 40. That is, fuel within the reservoir 38 is drawn through a fuel sock 62 and into the secondary pump 60 and exits through an exit port 64. The fuel may pass through a second pressure check valve 71, similar un operation to check valve 46, and then a second filter (not shown) before reaching a second pressure regulator 70.

The second pressure regulator 70 maintains a constant second fuel pressure, which is greater than the first fuel pressure provided by the primary pump 40, while the secondary pump 60 is powered on. The check valve opening pressure of a check valve associated with the second pump 60 is less than the difference between the second pressure and the first pressure. Excess fuel may be recirculated directly into the reservoir 38 or through a second jet pump tube and jet pump (both not depicted). Fuel then passes via the second pressure regulator 70 to the T-joint 59. Fuel may be supplied to the fuel line 14 at the second pressure while secondary pump 60 is powered on.

FIG. 7 depicts a second configuration including two fuel pump modules 18 according to the teachings of the present disclosure. The second configuration differs from the first configuration depicted in FIG. 6 in that the secondary pump 60 is separated from the primary pump 40, such as to accommodate various fuel tank configurations, such as a saddle fuel tank in a rear wheel drive vehicle. For example only, FIG. 7 depicts a "saddle" fuel tank 16' that includes two fuel pump module reservoirs 38 and 72, such as one module per saddle, or node, of the tank 16'. Saddle type fuel tanks normally have two lobes or nodes to hold fuel, for example, and may be located on either side of a drive shaft in a rear wheel drive vehicle.

In FIG. 7, primary pump 40 operates in the same manner as described in association with FIG. 6. Pressure regulator 50 recirculates excess fuel to jet pump tubes 52 and 74, and a transfer line 76. The transfer line 76 transfers fuel to the second reservoir 72. A transfer jet pump 78 uses the fuel from jet pump tube 74 to create a Venturi effect which draws fuel from the opposite side of the tank 16', that is the opposite saddle, via a second transfer line 80.

Continuing with FIG. 7, secondary pump 60 operates in the same manner as in FIG. 6. Fuel within the reservoir 72 is drawn into the secondary pump 60 through the fuel sock 62. Second pressure regulator 70 maintains fuel at the second pressure while fuel may exit or pass the regulator 70 to the T-joint 59 and continue to the fuel line 14.

Referring now to FIGS. 6 and 7, after engine 12 powers off and shuts down, heat may be released from various engine components that may increase the temperature of fuel in the fuel line 14. For example, vehicle 10 may not be moving due to the engine 12 being powered off. Temperatures near the fuel rail 24 may cause fuel to vaporize, such as within the fuel rail 24. Heat may be released while the engine 12 is running, such as at idle, and fuel flow in the fuel line 14 may be decreasing.

The vaporization of fuel may cause the fuel pressure to increase as the fuel expands. As a result, less liquid fuel may remain in the fuel line 14. When fuel pressure is low and/or fuel flow is low in the fuel line 14, the secondary pump 60 may be activated or powered on. For example, secondary pump 60 may be activated during engine starts. Secondary pump 60 may be activated based on an engine air temperature measured by an intake air temperature sensor, an engine-off time, fuel pressure, or an engine-on time determined by an engine controller. Secondary pump 60 may be activated on all engine starts.

While the secondary pump 60 may be activated during an engine start along with pump 1, the fuel line pressure in fuel line 14 increases to the second pressure, which is the pressure produced by the second pump 60. The differential pressure between the first pressure and the fuel line pressure is greater than the check valve opening pressure, so the pressure differential forces the flow check valve 56 to close. When flow check valve 56 is closed, fuel from primary pump 40 is blocked from the fuel line 14. Primary pump 40 continues to pump fuel through the jet pumps 54 and 78 and to draw fuel into the reservoirs 38 and 72. The second pressure generated by the secondary pump 60 causes re-absorption of any vapor in the fuel line 14 and increases liquid fuel mass.

When the secondary pump 60 is deactivated, such as after a successful engine start, the fuel line pressure decreases. The differential pressure between the first pressure and the fuel line pressure decreases below the check valve opening pressure because the first pressure, or pressure just before inlet 55, is greater than the pressure in the fuel line 14, or the pressure just after the outlet 57, with respect to the flow of fuel. When the pressure differential is less than the check valve opening pressure, the flow check valve 56 opens. When the flow check valve 56 is open, fuel from primary pump 40 flows to the fuel line 14. The fuel line pressure is no longer high enough to keep the flow check valve 56 closed because secondary pump 60 is powered off.

Additionally, secondary pump 60 may be activated to increase the fuel flow to the engine 12 when fuel flow from the primary pump 40 is insufficient to meet the volume of fuel required by the engine load. During high engine loads such as during wide open throttle (WOT), primary pump 40 may not be able to supply fuel at the first pressure, or that pressure and volume demanded, to meet the engine load. Pressure in the fuel line 14 may decrease below the first pressure as a fuel flow to the engine 12 increases. Secondary pump 60 may be activated to increase the fuel line pressure and fuel flow when the fuel line pressure decreases. A pressure sensor may be used to detect such a change in pressure.

For example only, when the fuel line pressure is less than or equal to a predetermined pressure, the secondary pump 60 may be activated to increase the fuel line pressure. The predetermined pressure may be based on feedback from sensors on the engine 12 such as a fuel rail pressure sensor. The secondary pump 60 may be activated based on feedback from oxygen sensors in the exhaust gas. The secondary pump may also be activated by a fuel pressure sensor. Oxygen sensors may detect when the engine receives an insufficient amount of fuel. The fuel line pressure may increase due to the second pressure and force the check valve 56 closed. Secondary pump 60 supplies fuel to the fuel line causing the fuel line pressure to increase to the second pressure.

The fuel line pressure may continue to decrease under continuing high engine loading. When the difference between the fuel line pressure and the first pressure is less than the check valve opening pressure, such as when the fuel line 14 pressure is greater than first pressure, the flow check valve 56 may open again. For example only, the secondary pump 60 alone may not supply a sufficient fuel flow to the engine 12. The pressure in the fuel line 14 may decrease and flow check valve 56 may open while the secondary pump 60 is activated. The fuel line pressure may decrease until the differential pressure across the check valve 56 is no longer sufficient to keep the flow check valve 56 closed. The primary pump 40 may then supply fuel to the fuel line 14 in addition to fuel from the secondary pump 60. The fuel flow rate may increase due to the added flow of the primary pump 40. The fuel line pressure may be maintained by the first pressure regulator 50 while the primary pump 40 and secondary pump 60 are both on and the flow check valve 56 is open.

Figure 10:
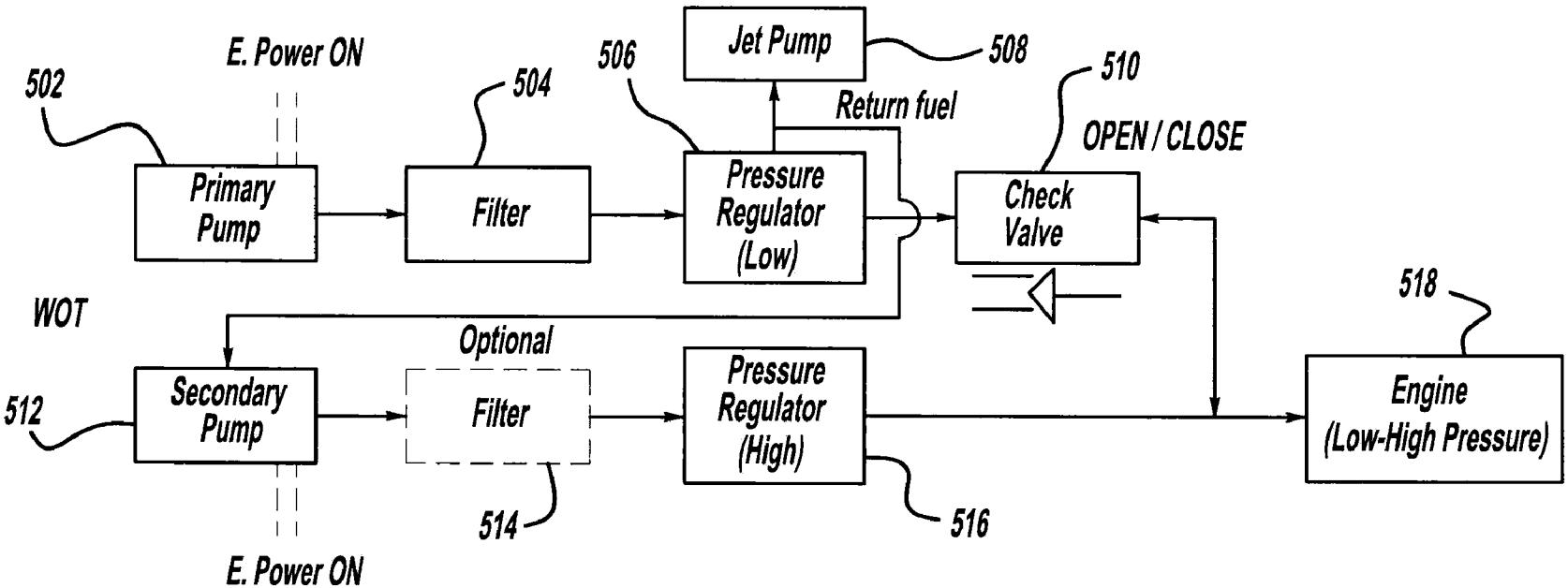

FIGS. 8-10 depict exemplary fuel flow patterns based on operation of the primary pump 40, flow check valve 56, and secondary pump 60 of FIGS. 6 and 7. FIG. 8 depicts a fuel flow pattern during normal driving operation of the MFRS. Normal driving may be light and moderate engine loads. In block 302, primary pump 40 is powered on while engine power is on. Fuel flows from the primary pump 40 through the filter 48 in block 304 and on to the first pressure regulator 50. In block 306, fuel flows through the first regulator 50 which maintains the fuel pressure at the first pressure. In block 308, excess fuel may be circulated to jet pumps 54 and 78. The check valve 56 is open in block 310, and fuel flows to the engine 12 where the constant fuel pressure is maintained.

Secondary pump 60 is not activated as seen in block 312. Fuel does not flow through the optional filter in block 314 or to the second pressure regulator 70 in block 316. Fuel is supplied to the engine in block 318 at the constant pressure maintained by the first pressure regulator 50 in block 306.

FIG. 9 depicts a fuel flow pattern during an engine start. In block 402, primary pump 40 is powered on when engine power is on. Fuel flows from primary pump 40 through the filter 48 in block 404 and on to the first pressure regulator 50. In block 406, fuel flows through the first pressure regulator 50 which maintains the fuel pressure at the first pressure. In block 408, excess fuel may be circulated to jet pumps 54 and 78. In block 410, check valve 56 is closed due to pressure from secondary pump 60.

Secondary pump 60 is activated in block 412 during the engine start and may pump fuel through an optional filter in block 414 and on to the second pressure regulator 70. In block 416, second pressure regulator 70 maintains fuel pressure at the second pressure. The fuel line pressure increases to the second pressure. The difference between the second pressure and the first pressure is greater than the opening pressure of the check valve 56 in block 410. Therefore, flow check valve 56 is closed in block 410. Fuel is supplied to the engine 12 at the second pressure during the engine start in block 418.

FIG. 10 depicts a fuel flow pattern during high engine loads such as wide open throttle ("WOT"). In block 502, primary pump 40 is powered on when engine power is on. Fuel flows from primary pump 40 through the filter 48 in block 504 and on to the first pressure regulator 50. In block 506, fuel flows through the first pressure regulator 50 which maintains the fuel pressure at the first pressure. In block 508, excess fuel may be circulated to jet pumps 54 and 78. In block 510, the flow check valve 56 may be open.

As fuel flow and fuel pressure in the fuel line 14 decrease due to increased engine demand, secondary pump 60 is activated in block 512. Secondary pump 60 may pump fuel through an optional filter in block 514 and on to the second pressure regulator 70. Secondary pump 60 may be activated when the engine is under high load and fuel pressure in the fuel rail 24 decreases below the first pressure. In block 516, the second pressure regulator 70 maintains fuel pressure at the second pressure.

The fuel line pressure may increase to the second pressure and force the flow check valve 56 to close when the secondary pump 60 is activated. As engine load increases or continues at a high load, the fuel line pressure may continue to decrease. When the difference between the fuel line pressure and the first pressure are less than the check valve opening pressure, such as when the fuel pressure in the fuel line 14 is less than the first pressure, the flow check valve 56 may open again. Primary pump 40 may supply fuel to the fuel line at the first pressure. The additional fuel flow from the primary pump 40 increases the fuel flow rate in the fuel line 14 and the first pressure regulator 50 maintains the fuel line pressure at the first pressure. The flow check valve 56 may continue to open and close, with both the first pump 40 and the second pump 60 pumping fuel, as needed based on the difference between the fuel line pressure and the first pressure. The fuel line pressure may vary between the second pressure and the first pressure.

The system may further employ a second fuel pump 60 with an exit port 64 and a second fuel pump check valve 71. A second pressure regulator 70 may govern a pressure of fuel pumped by the second fuel pump 60 to a second pressure. A second pressure regulator exit tube may have a second exit tube first end and a second exit tube second end. The second exit tube first end may be attached to the second pressure regulator 70 to receive fuel pumped through the second pressure regulator 70. An engine fuel line 14 may deliver fuel to the engine 12 at an engine fuel line pressure. A flow check valve 56 may have a predetermined flow check valve open setting, such as a type governed with a spring, for example. The flow check valve 56 may also have a flow check valve inlet 55 and a flow check valve outlet 57. The flow check valve inlet 55 may be attached to the first exit tube second end. A connecting tube 58 may have a connecting tube first end and a connecting tube second end. The connecting tube first end may attach to the flow check valve outlet 57. A T-joint 59 may function as a fluid juncture and connect to the connecting tube second end, the second exit tube second end, and the engine fuel line 14. An open and close position of the flow check valve 56 may be governed by the predetermined flow check valve open pressure setting and an engine fuel line pressure.

The check valve open pressure setting may be less than a difference between the second pressure and the first pressure. The flow check valve is closed when a difference between the fuel line pressure of the fuel line 14 and the first pressure is greater than the flow check valve open pressure. The flow check valve is open when a difference between the fuel line pressure and the first pressure is less than the flow check valve open pressure. The flow check valve is open when a difference between the fuel line pressure and the first pressure is equal to the flow check valve open pressure. Fuel from the first fuel pump 40 en route to the fuel line 14 flows through the flow check valve 56, and the second fuel pump 60 supplies fuel to the fuel line 14 at the second pressure during engine starting.

As related to the present teachings, a method of controlling a fuel volume and a fuel pressure in an engine fuel line may entail providing fuel to an engine 12 through the engine fuel line 14 at a fuel line pressure; providing a first fuel pump 40, a first pump check valve 46, a first pressure regulator 50 and a first pressure regulator exit tube; providing a second fuel pump 60, a second pump check valve 71, a second pressure regulator 70 and a second pressure regulator exit tube; providing a flow check valve 56 with a flow check valve inlet 55 connected to an exit end of the first pressure regulator exit tube; providing a connector tube 58 to an outlet of the flow check valve 56; providing a joint, such as a T-joint 59, to fluidly join the second pressure regulator exit tube, the connector tube 58, and the engine fuel line 14.

Continuing, a method of operation may employ pumping a first volume of fuel from the first fuel pump 40, through the first pump check valve 46, through the first pressure regulator 50 and into a first pressure regulator exit tube, through the flow check valve 56 and into the connector tube 58, the first volume of fuel being at a first pressure. The flow check valve is closed when the fuel line pressure plus the flow check valve open pressure is greater than the first pressure. The flow check valve is open when the first pressure is greater than the fuel line pressure plus the flow check valve open pressure.

A second fuel pump may be employed for pumping a second volume of fuel from the second fuel pump, through the second pump check valve, through the second pressure regulator and into the second pressure regulator exit tube, the second volume of fuel being at a second pressure. The flow check valve allows fuel from the first fuel pump to supply fuel to the engine fuel line. The flow check valve may be positioned to a close position when an engine fuel line pressure is greater than the first pressure. The flow check valve may be positioned open when the fuel line pressure is less than the first pressure and the first pressure is greater than the check valve opening pressure. Pumping a second volume of fuel from the second fuel pump may further comprise activating the second fuel pump only during engine starting, with either the first pump turned on or off. Pumping a second volume of fuel from the second fuel pump may further comprise activating the second fuel pump only during engine wide open throttle. The first pump may reside in a first side of a saddle fuel tank and the second pump may reside in a second side of a saddle fuel tank.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The broad teachings of the disclosure may be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A vehicle fuel system comprising:

a fuel line that supplies fuel to an engine at a fuel line pressure;

a first fuel pump having an exit port and a first fuel pump check valve, the first fuel pump supplies fuel through the exit port and the first fuel pump check valve to the fuel line at a first pressure;

a first pressure regulator that regulates the first pressure of fuel supplied by the first fuel pump;

a second fuel pump that supplies fuel to the fuel line;

a second pressure regulator that regulates a second pressure of fuel supplied by the second fuel pump, the second pressure greater than the first pressure;

a flow check valve with a flow check valve inlet in communication with the exit port of the first fuel pump and a flow check valve outlet in communication with the fuel line, the flow check valve open and close position governed by a flow check valve open pressure setting, pressure at the flow check valve inlet, and pressure at the flow check valve outlet, the flow check valve is closed when a pressure at the flow check valve outlet is greater than the pressure at the flow check valve inlet;

wherein the flow check valve inlet pressure is greater than the sum of the flow check valve outlet pressure and the flow check valve open pressure setting; and fuel from the first fuel pump en route to the fuel line flows through the flow check valve.

2. The fuel system of claim 1, wherein the second fuel pump supplies fuel to the fuel line at the second pressure during an engine start.

3. A vehicle fuel system for delivering fuel to a vehicle engine, the system comprising:

a first fuel pump comprising:

an exit port; and a first fuel pump check valve;

a first pressure regulator that governs a pressure of fuel pumped by the first fuel pump to a first pressure;

a first pressure regulator exit tube with a first exit tube first end and a first exit tube second end, the first exit tube first end attached to the first pressure regulator to receive fuel pumped through the first pressure regulator;

a flow check valve attached to the first exit tube second end;

a second fuel pump comprising;

an exit port; and a second fuel pump check valve;

a second pressure regulator that governs a pressure of fuel pumped by the second fuel pump to a second pressure;

a second pressure regulator exit tube with a second exit tube first end and a second exit tube second end, the second exit tube first end attached to the second pressure regulator to receive fuel pumped through the second pressure regulator;

an engine fuel line that delivers fuel to the engine at an engine fuel line pressure;

a flow check valve with a predetermined flow check valve open setting, the flow check valve also having a flow check valve inlet and a flow check valve outlet, the flow check valve inlet attached to the first exit tube second end;

a connecting tube with a connecting tube first end and a connecting tube second end, the connecting tube first end attached to the flow check valve outlet;

a joint that is a fluid juncture and connects to the connecting tube second end, the second exit tube second end, and the engine fuel line, wherein a flow check valve open and close position is governed by the flow check valve open pressure setting and an engine fuel line pressure.

4. The fuel system of claim 3, wherein the check valve open pressure setting is less than a difference between the second pressure and the first pressure.

5. The fuel system of claim 3, wherein the flow check valve is closed when the fuel line pressure plus the flow check valve open pressure is greater than the first pressure.

6. The fuel system of claim 5, wherein the flow check valve is open when the first pressure is greater than the fuel line pressure plus the flow check valve open pressure.

7. The fuel system of claim 6, wherein the flow check valve is open when a difference between the fuel line pressure and the first pressure is equal to the flow check valve open pressure.

8. The fuel system of claim 7, wherein:

fuel from the first fuel pump en route to the fuel line flows through the flow check valve, and the second fuel pump supplies fuel to the fuel line at the second pressure during engine starting.

9. A method of controlling fuel volume and fuel pressure in an engine fuel line, the method comprising:

providing fuel to an engine through the engine fuel line at a fuel line pressure;

providing a first fuel pump, a first pump check valve, a first pressure regulator and a first pressure regulator exit tube;

providing a second fuel pump, a second pump check valve, a second pressure regulator and a second pressure regulator exit tube;

providing a flow check valve with a flow check valve inlet connected to an exit end of the first pressure regulator exit tube;

providing a connector tube to an outlet of the flow check valve;

providing a T-joint to fluidly join the second pressure regulator exit tube, the connector tube, and the engine fuel line;

pumping a first volume of fuel from the first fuel pump, through the first pump check valve, through the first pressure regulator and into a first pressure regulator exit tube, through the flow check valve and into the connector tube, the first volume of fuel being at a first pressure; and pumping a second volume of fuel from the second fuel pump, through the second pump check valve, through the second pressure regulator and into the second pressure regulator exit tube, the second volume of fuel being at a second pressure.

10. The method of claim 9, wherein the flow check valve allows fuel from the first fuel pump to supply fuel to the engine fuel line.

11. The method of claim 10, further comprising:

positioning the flow check valve closed when an engine fuel line pressure is greater than the first pressure.

12. The method of claim 10, further comprising:

positioning the flow check valve open when the fuel line pressure is less than the first pressure and the first pressure is greater than the check valve opening pressure.

13. The method of claim 9, wherein pumping a second volume of fuel from the second fuel pump further comprises activating the second fuel pump only during engine starting.

14. The method of claim 13, wherein pumping a second volume of fuel from the second fuel pump further comprises activating the second fuel pump during engine wide open throttle.

15. The method of claim 14, wherein the first pump is in a first side of a saddle fuel tank and the second pump is in a second side of a saddle fuel tank.

* * * * *

UNITED STATES PATENT AND TRADEMARK OFFICE

CERTIFICATE OF CORRECTION

PATENT NO. : 8,230,841 B2
APPLICATION NO. : 12/411119
DATED : July 31, 2012
INVENTOR(S) : Kingo Okada et al.

It is certified that error appears in the above-identified patent and that said Letters Patent is hereby corrected as shown below:

IN THE CLAIMS:

Col. 10, line 36, claim 5, replace “claim 3” with --claim 4--

Signed and Sealed this
Eighteenth Day of December, 2012

David J. Kappos

David J. Kappos
*Director of the United States Patent and Trademark Office*